United States Patent [19]

Shimoishi

[11] 4,207,013

[45] Jun. 10, 1980

[54] WRITING INSTRUMENT

[75] Inventor: Tetsuo Shimoishi, Hamamatsu, Japan

[73] Assignee: Teibow Company Limited, Hamamatsu, Japan

[21] Appl. No.: 804,895

[22] Filed: Jun. 9, 1977

[30] Foreign Application Priority Data

May 30, 1977 [JP] Japan ..... 52-20598[U]

[51] Int. Cl.[2] ..... B43K 1/12; B53K 15/00

[52] U.S. Cl. ..... 401/265; 401/199

[58] Field of Search ..... 401/196, 198, 199, 265, 401/261, 134, 135

[56] References Cited

U.S. PATENT DOCUMENTS

| | | | |
|---|---|---|---|
| 3,094,736 | 6/1963 | Bunzl et al. | 401/198 |
| 3,404,055 | 10/1968 | Wieland et al. | 401/265 X |
| 3,592,552 | 7/1971 | Malm | 401/199 X |
| 3,932,044 | 1/1976 | Otake et al. | 401/292 X |
| 4,057,354 | 11/1977 | Bajusz et al. | 401/292 X |

FOREIGN PATENT DOCUMENTS

| | | | |
|---|---|---|---|
| 1461621 | 5/1969 | Fed. Rep. of Germany | 401/198 |
| 51-104021 | 8/1976 | Japan | 401/292 X |
| 1204400 | 9/1970 | United Kingdom | 401/198 |

*Primary Examiner*—William Pieprz

*Attorney, Agent, or Firm*—Irving M. Weiner; Pamela S. Burt; Melvin Yedlin

[57] ABSTRACT

An improved writing instrument comprising a casing, ink reservoir in the casing, a longitudinal nib having a capillary passage for the ink in the ink reservoir, and a longitudinal nib holder, with a bore, of a thermoplastic material which is fixedly mounted to the casing, the nib being inserted into the holder so that the forward end portion and the rear end portion of the nib are projected outwardly from the holder and being fixed to the holder with an adhesive material at a place between the forward end portion and the rear end portion of the nib, while the holder at the tip edge thereof is deformed so that the inner surface of the holder is in tight contact with the nib around the circumference thereof.

4 Claims, 6 Drawing Figures

WRITING INSTRUMENT

The present invention relates to a writing instrument comprising a casing, an ink reservoir, a writing nib of synthetic resin material having at least one capillary passage for the ink and a nib holder, and more particularly relates to a combination of the nib and the nib holder.

Exemplary techniques regarding the press-fit of a nib within a nib holder are disclosed in: Japanese Patent Application No. 45-26633 (Publication No. 49-48006); U.S. Pat. No. 2,392,840; U.S. Pat. No. 2,528,921; U.S. Pat. No. 2,713,176; U.S. Pat. No. 3,057,000; U.S. Pat. No. 3,069,767; U.S. Pat. No. 3,080,600; U.S. Pat. No. 3,089,182; U.S. Pat. No. 3,141,187; U.S. Pat. No. 3,221,360; U.S. Pat. No. 3,230,574; U.S. Pat. No. 3,231,924; U.S. Pat. No. 3,278,976; U.S. Pat. No. 3,345,674; Japanese Utility Model Application No. 39-72761 (Publication No. 41-18327); Japanese Application No. 43-79878 (Publication No. 48-11889); Japanese Application No. 44-9782 (Publication No. 49-7690); Japanese Application No. 42-1809 (Publication No. 52-33313); Japanese Application No. 48-4953 (Publication No. 52-33313); Japanese Application No. 47-82593 (Publication No. 52-46172); Japanese Application No. 49-154313 (Disclosure No. 51-80224); Japanese Application No. 50-15439 (Disclosure No. 51-98633); Japanese Application No. 50-22289 (Disclosure No. 51-104021); Japanese Application No. 50-31732 (Disclosure No. 51-112622); and Japanese Application No. 51-23926 (Disclosure No. 52-116325).

Writing instruments which appear somewhat similar to the present invention are on the market, most of which are provided with plastic nibs having a diameter of 1 mm to 2 mm. The nib holder used in such a conventional instrument is a ring band or a hollow extension through which the nib extends and is made of a metallic material. Such metallic holder is combined with the nib by a well known press-contacting method such as one of the following.

In a first method a metallic holder is radially pressed at least at separated points around the circumference of the outer surface at a point between the two ends of the holder. The radial inward projections of the holder resulting from this pressing are forced into the plastic nib from the outer surface thereof. In a second method the circumferential tip of the metallic holder is pressed so that the deformed tip is forced into the plastic nib at least at separated points around the circumference of the outer surface thereof. In a conventional instrument, either one of the above described methods is applied or both methods are applied in combination. In general, it is desired that the writing instrument comply with the following requirements.

1. The holder holds the nib tightly enough to prevent the forward end portion of the nib from being forced into the holder, when the writing instrument is used under a writing pressure of 1.2 kg through 1.5 kg.

2. An external pressure applied against the outer surface of the nib, while the nib is combined with the holder, does not cause the sectional configuration of the capillary passage of the nib to be changed.

If the sectional configuration of the capillary passage were changed at the place between the forward end and rear end of the nib by pressure on the holder, the amount of ink supplied from the ink reservoir through the capillary passage of the nib would be reduced. If such a change as above were made at the forward end of the nib, a problem, such as scratching during writing, would be the result.

Irrespective of the sectional size of the nib, the requirement 1 above is desired. However, a fine nib is deformed more than a coarse nib under the same external pressure since the fine nib has a thinner circumferential wall than the coarse nib. In this connection, in the conventional writing instrument, it is difficult to comply with both requirements 1 and 2 above in the case of a nib having a smaller diameter, that is a thin nib.

If only the press-contacting first method mentioned above is applied to a thin nibbed writing instrument, the nib holder of the instrument will allow the forward end of the nib to move transversely within the gap between the nib and the holder. This results in the writing action of a hand gripping the instrument not being transmitted correctly to the tip of the nib on a piece of paper. If only the press-contacting second method mentioned above is applied, the writing action can be correctly transmitted to the tip of the nib. However, in this case the combination of the nib and holder will not always comply with the requirement 1 above.

Under the circumstances, no one has succeeded in providing a writing instrument with a very fine nib having a diameter such as between 0.5 mm to 0.8 mm, which also complies with the requirements 1 and 2, above, and with which the writing action of a hand is always correctly transmitted to the tip of the nib.

An object of the present invention is to provide a writing instrument with a very thin nib, which does not involve any of the above-mentioned problems of the conventional writing instrument, at a low production cost.

The writing instrument of the present invention comprises a cylindrical casing having a constricted forward end which forms a bore in communication with the interior space of said casing; an ink reservoir mounted in said casing at the rear portion thereof; an elongated plastic writing nib having a rear end portion inserted into said ink reservoir and a forward end portion projecting from the forward end of said casing, said nib having at least one capillary passage for the ink to pass therethrough, and; a nib holder which holds said ink and which is tightly fitted into the forward end of said casing. The improvement of the present invention resides in the following construction. The holder is made of a thermoplastic material and is elongated with a bore therethrough. The nib extends through the bore of the holder so that the forward and rear end portions of the nib are projected from the corresponding ends of the holder, respectively. The holder is fixed, at the center portion thereof, to the nib with an adhesive material and is deformed at the tip edge of the forward end portion thereof so that the inner surface of the holder is in tight contact with the nib at least at separated points around the circumference of the outer surface of the nib.

According to the present invention, the nib is not press-contacted with the nib holder at any point and, thus, is neither subjected to any substantial pressure nor deformed. In spite of these facts, the nib is held by the holder tightly enough to prevent the forcing of the nib into the holder during writing. Further, the writing action is always correctly transmitted to the tip of the nib, since the forward end portion of the nib is in tight contact with the holder at the circumferential tip thereof. The reason for the tight contact is not to fix the nib to the holder, but to prevent the forward end portion of the nib from moving transversely within the holder.

According to the present invention, the nib is combined with the holder easily by using an adhesive material and a hot die. The die has a cavity designed to receive the forward end portions of the nib and the holder in such a way that only the tip edge of the forward end portion of the holder is pressed against the die. When the holder is inserted into the hot die under a pressure, the tip of the holder is partially plasticized and partially deformed, so that the tip of the inner surface of the holder comes into tight contact with the outer surface of the nib at least at separated points around the circumference of the nib surface. Of course, the tip of the nib holder may also be in tight contact with the nib all around the circumference of the nib surface. However, it is important to note that no deformation of the nib occurs.

The present invention will hereinafter be more fully described with reference to the accompanying drawings.

DETAILED DESCRIPTION

Figure 1:
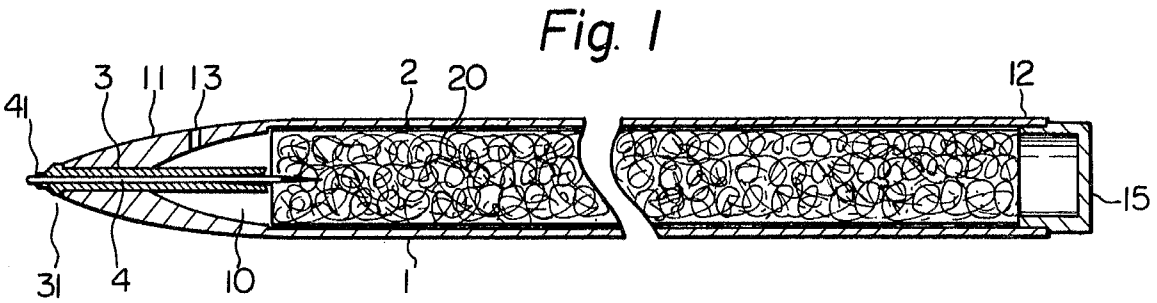
FIG. 1 is a side cross-sectional view of the writing instrument of the present invention.

Referring to FIG. 1, the writing instrument of the present invention has a cylindrical casing 1 having a constricted forward end 11 which forms a bore and having a rear open end. A cap 15 is detachably push-mounted to the rear end 12 of the casing 1. An ink reservoir 2, which is replaceable, is housed in a space 10 which is defined by the interior of the casing 1. A vent hole 13, which allows atmospheric pressure to enter the interior space 10, is provided in the wall of the casing 1 adjacent to the forward end of the casing. The ink reservoir 2 includes a cylindrical fibrous block 20, in which ink is reserved. The ink reservoir 2 is inserted into the casing 1 through the rear end aperture of the casing. After insertion of the ink reservoir 2, the cap 15 is attached to the rear end of the casing 1.

Figure 2:
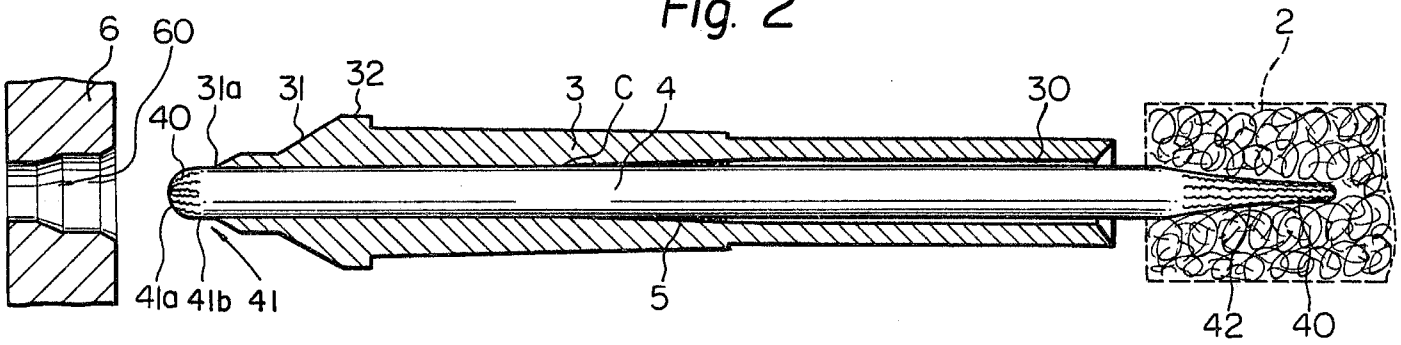
FIG. 2 is an enlarged side cross-sectional view of the nib and the nib holder in combination according to the present invention.

Referring to FIGS. 1 and 2, a nib holder 3 is made of a thermoplastic synthetic resin and has a bore 30 therethrough. The bore 30 of the holder has such a configuration that the bore diameter is constant over its length from the forward end to the middle point C and increases over its remaining length from the middle point C to the rear end. The point C is a boundary of the forward portion and the rear portion of the holder 3. The forward end portion 31 of the holder 3, which is to project from the forward end of the casing 1, has a circumferential outer projection 32 which abuts against the forward end of the casing 1 when the holder is inserted into the casing 1 through the bore thereof.

Figure 3A:
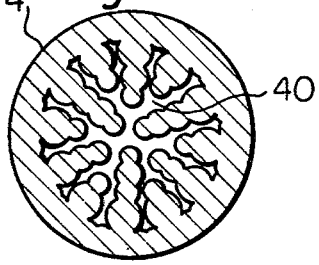
FIGS. 3A and 3B are enlarged cross-sectional views of the nibs preferably used in the writing instrument of the present invention.
Figure 3B:
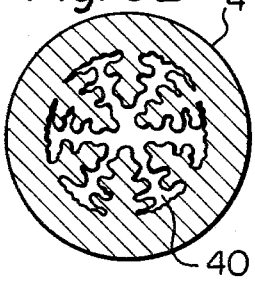

A writing nib 4 is made of a thermoplastic synthetic resin and has a capillary passage 40 therethrough. The capillary passage 40 has a preferable cross-sectional configuration as shown in FIG. 3A or FIG. 3B. The nib 4 has a diameter such that the nib can be inserted into the holder 3 in a loose fitting manner with a slight clearance between the nib and holder.

The length of the holder 3 is designed so that, when the nib is inserted into the holder 3, the forward end portion 41 of the nib 4 and rear end portion 42 of the nib 4 project from the corresponding forward and rear ends of the holder 3, respectively. The forward end portion 41 of the nib has a round tip 41*a* and a straight portion 41*b* following the tip 41*a* (FIG. 2), while the rear end portion 42 of the nib has a tapered form. The capillary passage 40 is open along the tapered surface of the rear end portion 42.

After the nib 4 and the holder 3 are combined in a manner which will be described later, they are inserted into the casing 1 and, thus, the rear end portion 42 of nib 4 pierces the ink reservoir 2 housed in the casing 1. The forward end bore of the casing 1 is designed small enough for the holder 3 to fit tightly into the forward end bore. The holder 3 is preferably designed so that it is long enough to reach a position in the vicinity of the forward end of the ink reservoir 2 when the combination of the nib and the holder is fixedly mounted in the forward end of the casing.

The nib is first partially coated with an adhesive material 5 at the point corresponding to the point C of the holder or a point forwardly adjacent to said point, around the circumference of the nib surface. Then the nib is inserted into the holder 3 from the rear end thereof and is kept in a predetermined position relative to the holder. As a result, the holder 3 is fixed to the nib with the adhesive material 5 at the central point C. Of course, the nib and the holder may be fixed together with the adhesive material anywhere within the region where the boundary of the forward portion and the rear portion of the holder (point C) lies.

In a case where the nib and holder are made of polyacetal resins, a preferable adhesive material is one which is selected from the group consisting of epoxy resin system adhesives, cyanoacrylate system adhesives, nitryl rubber system adhesives, or silicone rubber system adhesives.

Figure 4A:
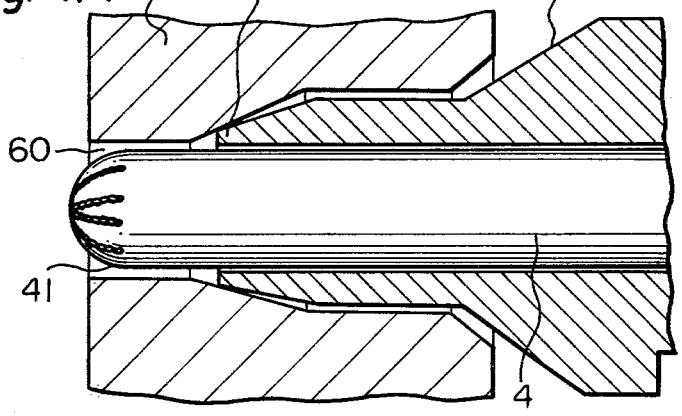
FIGS. 4A and 4B are enlarged side cross-sectional views of the forward end portions of the nib and the nib holder in combination and a hot die, according to the present invention, showing a process of deforming the nib holder with the hot die.

After the nib 4 is fixed to the holder 3 as mentioned above, the resultant combination of the nib and holder is forced into a hot die 6 as shown in FIGS. 2 and 4A. The hot die 6 has a cavity 60 designed in such a way that it can receive the forward end portion 41 of the nib 4 and the forward end portion 31 of the holder 3 and abut against only the tip edge 31*a* of the forward end portion of the holder as shown in FIGS. 4A and 4B.

Figure 4B:
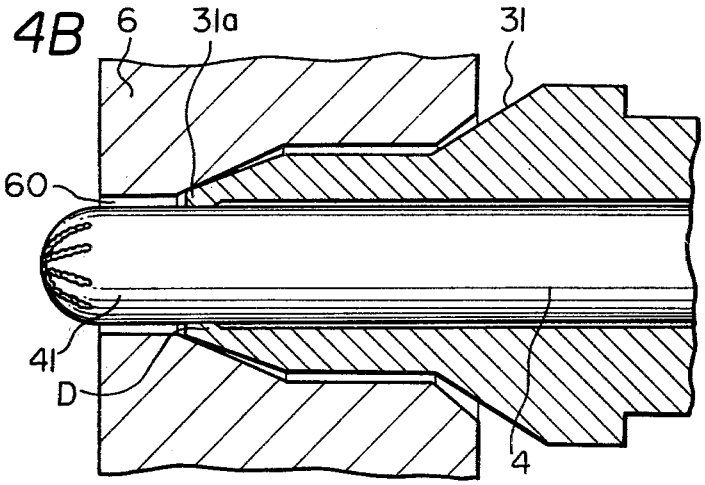

The holder 3 is partially plasticized at the tip edge 31*a* when the tip edge is pressed against the hot die 6 shown in FIGS. 4A and 4B, and thus the tip of the holder is deformed so that the inner surface of the holder 3 is in tight contact with the intermediate portion of the nib 4 around the circumference of the outer surface of the nib. As shown, such outer surface of the intermediate portion of the nib is substantially cylindrical, without substantial surface interstices, and is continuously parallel to the longitudinal axis of the nib. The letter D in FIG. 4B denotes the deformation of the holder tip. If the hot die 6 is designed so that the cavity 60 abuts against the tip edge 31*a* of the holder at a few separated points around the circumference of the edge of the tip, the holder is deformed so that the inner surface of the holder can be in tight contact with the nib at the corresponding separated points around the circumference of the nib surface. If the hot die 6 is designed so that the cavity 60 abuts against the tip edge 31*a* of the holder all around the circumference thereof, the holder is deformed so that the inner surface of the holder can be in tight contact with the nib all around the circumference of the nib surface. The two kinds of contacts mentioned above may not prevent the forward end portion 41 of the nib 4 from being forced into the holder 3 during writing, but either one will prevent the forward end portion 41 of the nib 4 from moving transversely relative to the holder within the bore thereof. It is the adhesive material 5 which prevents the forcing of the forward end portion 41 of the nib 4 into the holder 3 under a writing pressure, on the tip of the nib, up to 1.5 kg or more.

The degree of deformation of the holder 3 by the hot die 6 depends on the temperature of the die, the resin material of the holder, the pressure on the tip edge of the holder in the die and the amount of time the holder is in the die. In practice, a preferable temperature of the die 6 is in a range from 60° C. to 130° C. and a preferable amount of the adhesive material 5 applied to a nib is in a range from 0.5 mg to 2.0 mg.

According to the present invention, the holder is deformed only at the tip edge thereof, but the nib is never deformed anywhere over its length. Thus, the nib will always permit a predetermined volume of ink to pass through the capillary passage without any problem such as scratching, when it is used for writing.

According to the present invention, the holder 3 is preferably designed so that it covers the full length of the nib except for the tip 41*a* of the nib and the rear end portion 42 inserted into the ink reservoir 2. This results in an advantage in that the rear portion of the holder, having the bore of increasing diameter, prevents the nib from being broken, when the combination of the nib and holder is fixedly mounted to the casing, and thus the rear portion of the nib is inserted into the ink reservoir, even if the nib has a small diameter such as of 0.5 mm to 0.8 mm.

What is claimed is:

1. In a writing instrument comprising: a cylindrical casing having a constricted forward end which forms a bore in communication with the interior space of said casing; an ink reservoir mounted in said casing at the rear portion thereof; an elongated plastic nib having a rear end portion inserted in said ink reservoir and a forward end portion projecting from the forward end of said casing, said projected forward end portion comprising a tip portion and a straight portion following said tip portion, said straight portion having a predetermined diameter, said nib having at least one capillary passage for the ink therethrough, and; an elongated nib holder which holds said nib and which is tightly fitted in the forward end of said casing: the improvement that said holder is of a thermoplastic material and has a bore therethrough, and said nib extends through the bore of said holder so that the forward and rear end portions of said nib are projected outwardly from the corresponding ends of said holder, respectively, the intermediate portion of said nib between said forward and rear end portions thereof having an outer substantially cylindrical surface without substantial surface interstices, which is continuously parallel to the longitudinal axis of said nib, said holder within the region between the forward end and rear end thereof being fixed to said nib with an adhesive material and the tip edge of the forward end portion thereof being plasticized and deformed so that it is in tight contact with said outer surface of said intermediate portion of said nib at least at separated points around the circumference of the outer surface of said nib, said bore of said holder having a forward portion of a constant diameter over its length and the remaining rear portion of said bore having a diameter which increases toward the rear of said holder, said holder being fixed to said nib, within the region where the boundary between said forward and rear portions of said bore lies, with said adhesive material.

2. A writing instrument according to claim 1 wherein said intermediate portion of said nib has a constant outer diameter of not more than 1.0 mm over the length and said forward end portion of said nib projecting outwardly from the forward end of said holder has a round tip and said rear end portion of said nib projecting into said ink reservoir is of a tapered form, said capillary passage being open along the tapered surface of said rear nib end.

3. A writing instrument according to claim 1, wherein said nib has a diameter, such that said nib is fitted into said holder with a clearance between said nib and the rear portion of said holder which is distal to said tip edge of said forward end portion of said holder.

4. A writing instrument according to claim 1, wherein said intermediate portion of said nib has a constant outer diameter of not more than 1.0 mm over the length and said forward end portion of said nib projecting outwardly from the forward end of said holder has a tapered tip and the rear end portion of said nib projecting into said ink reservoir is of a tapered form, said capillary passage being open along the tapered surface of said rear nib end.

* * * * *

UNITED STATES PATENT AND TRADEMARK OFFICE

CERTIFICATE OF CORRECTION

PATENT NO. : 4,207,013

DATED : June 10, 1980

INVENTOR(S) : Tetsuo Shimoishi

It is certified that error appears in the above-identified patent and that said Letters Patent are hereby corrected as shown below:

On the title page, after "[30] Foreign Application Priority Data", change:

"May 30, 1977 [JP] Japan.....52-20598[U]" to

--May 30, 1977 [JP] Japan.....52-70598[U]--.

Signed and Sealed this

*Fourth* Day of *November 1980*

[SEAL]

*Attest:*

SIDNEY A. DIAMOND

*Attesting Officer*

*Commissioner of Patents and Trademarks*